US010790105B1

(12) United States Patent
Cho et al.

(10) Patent No.: US 10,790,105 B1
(45) Date of Patent: Sep. 29, 2020

(54) DC SWITCHING APPARATUS WITH AUXILIARY CONTACT DEVICE USING MICROSWITCH

(71) Applicant: YM Tech Co., Ltd., Cheongju-si, Chungcheongbuk-do (KR)

(72) Inventors: Hyun Kil Cho, Sejong-si (KR); Su Pyo Hong, Cheongju-si (KR); Seung Min Lee, Gyeongsangbuk-do (KR)

(73) Assignee: YM Tech Co., Ltd., Cheongju-si (KR)

( * ) Notice: Subject to any disclaimer, the term of this patent is extended or adjusted under 35 U.S.C. 154(b) by 0 days.

(21) Appl. No.: 16/874,070

(22) Filed: May 14, 2020

(30) Foreign Application Priority Data

May 16, 2019 (KR) ..... 10-2019-0057455

(51) Int. Cl.
*H01H 67/02* (2006.01)
*H01H 36/00* (2006.01)

(52) U.S. Cl.
CPC ..... *H01H 36/00* (2013.01); *H01H 2036/0093* (2013.01)

(58) Field of Classification Search
CPC ..... H01H 36/00; H01H 2036/0093
See application file for complete search history.

(56) References Cited

U.S. PATENT DOCUMENTS 3,593,232 A * 7/1971 Shibuya ..... H01H 71/46 335/160
4,651,136 A * 3/1987 Anderson ..... E05B 73/0017 24/110
6,831,535 B1 * 12/2004 Wen ..... H01H 51/2209 335/132
7,098,416 B2 * 8/2006 Puhalla ..... H01H 71/465 200/330
7,868,720 B2 * 1/2011 Bush ..... H01H 50/023 335/151
8,305,169 B2 * 11/2012 Suzuki ..... F02N 11/087 335/126
9,159,512 B2 * 10/2015 Kodama ..... H01H 50/541

FOREIGN PATENT DOCUMENTS

JP H0559736 U 8/1993
JP H06275351 A 9/1994
JP 2012199115 A 10/2012

OTHER PUBLICATIONS

Office Action on Korean Application No. 10-2019-0057455 dated Jul. 19, 2019.

* cited by examiner

*Primary Examiner* — Alexander Talpalatski
(74) *Attorney, Agent, or Firm* — Dinsmore & Shohl LLP; Yongsok Choi, Esq.

(57) ABSTRACT

A direct current (DC) switching apparatus is provided. The DC switch apparatus includes an auxiliary contact device includes at least one pair of stationary contacts; one or more coils, a movable iron core that is driven by the one or more coils; a movable contact table operating in engagement with the movable iron core, and an auxiliary contact device arranged below the movable iron core. The auxiliary contact device includes a microswitch.

7 Claims, 6 Drawing Sheets

DC SWITCHING APPARATUS WITH AUXILIARY CONTACT DEVICE USING MICROSWITCH

CROSS-REFERENCE TO RELATED APPLICATION

This application claims priority to Korean Patent Application No. 10-2019-0057455 filed on May 16, 2019, the entire contents of which are herein incorporated by reference.

TECHNICAL FIELD

The present invention relates to a direct current (DC) switching apparatus (relay) having an auxiliary contact device using a microswitch. More specifically, the present invention relates to a structure of an auxiliary contact device included in a DC high-voltage contact switching apparatus that is applicable to new renewable energy, electric vehicles, DC power control, battery power control, and the like.

BACKGROUND ART OF THE INVENTION

Direct current (DC) switching apparatuses may be used in new renewable energy (such as, solar energy generation), energy storage devices, and DC transportation systems such as electric bus rapid-charging devices. Recent energy storage devices and recent electric bus rapid-charging systems tend to increase a voltage up to a high voltage of 1000V and gradually increase a current. With this voltage increase, a device that shuts off (+) power and (−) power simultaneously is required for safety.

An auxiliary contact device is also required as a contact monitoring device for checking whether a main contact has been operated. The contact monitoring device such as the auxiliary contact device is used to operate the entire system after checking whether the main contact has entered a closed circuit state after applying power to the coil of a switching apparatus, and is also used to check whether the main contact has been properly opened or closed when the operation of the entire system is stopped. The contact monitoring device may also be used to detect a defect when the defect is generated in the main contact due to a short-circuit accident or other accidents while the entire system is being operated. In this case, reliability of the contact monitoring device or the auxiliary contact device is greatly important.

In the conventional art, the auxiliary contact device is completed by fixing an microswitch on a PCB to the bottom surface of an arc cover via soldering, taking auxiliary contact terminals out of the PCB via soldering, and guiding the taken-out terminals to an upper portion encapsulated by high-density epoxy to solder connection wires from the outside. At this time, airtight sealing of epoxy is degraded due to soldering, insulation between a main contact and an auxiliary contact is destroyed due to soldering of a covered wire between the externally taken-out terminals of the auxiliary contact, an operation is difficult, the reliability of the auxiliary contact is degraded due to an arc voltage and arc heat, and burning occurs.

SUMMARY

Technical Problem

Provided is implementation of an auxiliary contact of a sealed direct current (DC) switching apparatus capable of stably protecting insulation of a microswitch, which is to be used as the auxiliary contact, and the auxiliary contact in a harsh opening/closing environment of a DC power supply of a main contact, and securing an operational reliability of the auxiliary contact, which transmits an electrical signal, by accurately monitoring an operational state of the main contact.

Provided is also a DC switching apparatus having an auxiliary contact device designed to protect an auxiliary contact from arc and arc heat caused by opening/closing of a main contact by securing an insulation distance of a DC power supply, to monitor an operational state of the main contact at a remote distance, and to facilitate utilization of the auxiliary contact for a reliability-secured accurate feedback, and being capable of securing insulation by arranging the auxiliary contact at a farthest location from the main contact, of preventing a malfunction of the auxiliary contact due to arc heat, and of contributing to sealing securement of the inside of a product, productivity improvement, and cost saving.

Provided is also a DC switching apparatus having an auxiliary contact device optimally designed to protect a microswitch, which is to be used as an auxiliary contact, from arc generated during opening/closing of a main contact by arranging the microswitch on a bottom surface of a movable iron core in order to secure an insulation distance from the arc and optimally designed to satisfy an international standard by increasing a space distance and a creeping distance.

Provided is also a method and apparatus capable of reducing the conventional inconveniences of soldering a microswitch onto a PCB, accurately soldering an externally connected terminal to the PCB, and soldering the terminal to the outside by using a lead line of an insulating wire.

Provided is also a method and apparatus capable of minimizing infiltration of a carbon material generated during opening/closing of a contact due to arc and opening/closing of a main contact into an auxiliary contact because the opening/closing of the contact occurs within a small space.

Provided is also an auxiliary contact device of a DC high-voltage contact switching apparatus such as battery control, an ESS, an electric vehicle, a charger, a UPS, or a solar-light inverter, which is a DC power supply that blocks a corrosive gas such as oxygen into a product because the inside of a contact portion is completely blocked from the outside and ambient air is completely blocked.

Provided is also a DC relay including an auxiliary contact device of a DC high-voltage contact switching apparatus including a reliability-secured auxiliary contact that controls opening/closing of a DC power supply by reducing the size, being mounted under a reducing insulating gas atmosphere to prevent oxidation of a contact, being manipulated under the insulating gas atmosphere, and monitoring a state of a main contact to facilitate remote control via communication, battery management system (BMS) control, or the like.

The technical problems of the present invention are not limited to the above-mentioned contents, and other technical problems not mentioned will be clearly understood by a person skilled in the art from the following description.

Solution to Problem

According to an aspect of the present disclosure, a direct current (DC) switching apparatus having an auxiliary contact device includes at least one pair of stationary contacts; one or more coils; a movable iron core that is driven by the one or more coils; a movable contact table operating in engagement with the movable iron core; and an auxiliary contact device arranged below the movable iron core, wherein the auxiliary contact device includes a microswitch.

The auxiliary contact device may further include a cylinder of which a top and a bottom are open, the cylinder including an upper circumferential portion and a lower circumferential portion; and a ceramic base configured to be airtightly bonded with the lower circumferential portion of the cylinder.

A terminal of the microswitch may be fitted onto and fixed to an auxiliary contact terminal formed in the ceramic base, and may transmit an electrical signal to the outside by being electrically connected to the auxiliary contact terminal.

A first metalized layer may be formed on an outer circumferential portion of the ceramic base, and the first metalized layer and a lower circumferential portion of the cylinder may be bonded with each other via airtight welding.

The ceramic base may include a through hole through which the terminal of the microswitch penetrates, and the auxiliary contact terminal may be bonded with the ceramic base via airtight welding by using a second metalized layer formed on the through hole.

The microswitch may include an auxiliary contact lever, may monitor a state of a main contact through the auxiliary contact terminal by a lower portion of the movable iron core operating the auxiliary contact lever through a vertical action of the movable iron core, and may be configured to be filled with an insulating gas.

The terminal of the microswitch may be coated with a solder and then fitted onto the auxiliary contact terminal, and the terminal of the microswitch and the auxiliary contact terminal may be electrically connected to each other by heating the auxiliary contact terminal from the outside.

The auxiliary contact terminal may be formed of oxygen-free copper, and at least a portion of the lower circumferential portion of the cylinder may be plated with nickel, and thus the lower circumferential portion of the cylinder and the first metalized layer of the ceramic base may be bonded with each other via brazing welding.

The upper circumferential portion of the cylinder may be formed in an outward direction to be perpendicular to the cylinder, and the lower circumferential portion of the cylinder may be formed in an inward direction to be perpendicular to the cylinder.

Effects of the Invention

According to the present invention, provided is implementation of an auxiliary contact of a sealed direct current (DC) relay capable of stably protecting insulation of a microswitch, which is to be used as the auxiliary contact, and the auxiliary contact in a harsh opening/closing environment of DC power of a main contact, and securing an operational reliability of the auxiliary contact, which transmits an electrical signal, by accurately monitoring an operational state of the main contact.

According to the present invention, provided is also a DC switching apparatus having an auxiliary contact device designed to protect an auxiliary contact from arc and arc heat caused by opening/closing of a main contact by securing an insulation distance of a DC power supply, to monitor an operational state of the main contact at a remote distance, and to facilitate utilization of the auxiliary contact for a reliability-secured accurate feedback, and being capable of securing insulation by arranging the auxiliary contact at a farthest location from the main contact, of preventing a malfunction of the auxiliary contact due to arc heat, and of contributing to sealing securement of the inside of a product, productivity improvement, and cost saving.

According to the present invention, provided is also a DC switching apparatus having an auxiliary contact device optimally designed to protect a microswitch, which is to be used as an auxiliary contact, from arc generated during opening/closing of a main contact by arranging the microswitch on a bottom surface of a movable iron core in order to secure an insulation distance from the arc and optimally designed to satisfy an international standard by increasing a space distance and a creeping distance.

According to the present invention, provided is also a method and apparatus capable of reducing the conventional inconveniences of soldering a microswitch onto a PCB, accurately soldering an externally connected terminal to the PCB, and soldering the terminal to the outside by using a lead line of an insulating wire.

According to the present invention, provided is also a method and apparatus capable of minimizing infiltration of a carbon material generated during opening/closing of a contact due to arc and opening/closing of a main contact into an auxiliary contact because the opening/closing of the contact occurs within a small space.

According to the present invention, provided is also an auxiliary contact device of a DC high-voltage contact switching apparatus such as battery control, an ESS, an electric vehicle, a charger, a UPS, or a solar-light inverter, which is a DC power supply that blocks a corrosive gas such as oxygen into a product because the inside of a contact portion is completely blocked from the outside and ambient air is completely blocked.

According to the present invention, provided is also a DC relay including an auxiliary contact device of a DC high-voltage contact switching apparatus including a reliability-secured auxiliary contact that controls opening/closing of a DC power supply by reducing the size, being mounted under a reducing insulating gas atmosphere to prevent oxidation of a contact, being manipulated under the insulating gas atmosphere, and monitoring a state of a main contact to facilitate remote control via communication, battery management system (BMS) control, or the like.

The effects of the present invention are not limited to the above-mentioned contents, and other effects not mentioned will be clearly understood by a person skilled in the art from the following description.

DETAILED DESCRIPTION

The present invention will now be described more fully with reference to the accompanying drawings, in which exemplary embodiments of the invention are shown. The present invention may, however, be embodied in many different forms and should not be construed as being limited to the embodiments set forth herein.

The terminology used herein is for the purpose of describing particular embodiments only and is not intended to limit the present invention. As used herein, the singular forms "a", "an" and "the" are intended to include the plural forms as well, unless the context clearly indicates otherwise.

It will be understood that the terms "comprises" and/or "comprising," when used in this specification, specify the presence of stated components, steps, operations, and/or elements thereof, but do not preclude the presence or addition of one or more other components, steps, operations, and/or elements thereof.

While such terms as "first", "second", etc., may be used to describe various components, such components must not be limited to the above terms. The above terms are used only to distinguish one component from another. In the description, certain detailed explanations of the related art are omitted when it is deemed that they may unnecessarily obscure the essence of the present invention.

In addition, the components shown in the embodiments of the present invention are shown independently to indicate different characteristic functions, and do not mean that each component is separate hardware or one software component. In other words, for convenience of description, each component is listed and described as each component, and at least two components of each component may be combined to form one component, or one component may be divided into a plurality of components to perform a function. The integrated and separate embodiments of each component are also included in the scope of the present invention without departing from the essence of the present invention.

Hereinafter, the present invention will be described more fully with reference to the accompanying drawings, in which exemplary embodiments of the inventive concept are shown. The configuration of the present invention and the effect of the action thereof will be clearly understood through the following detailed description.

Figure 1:
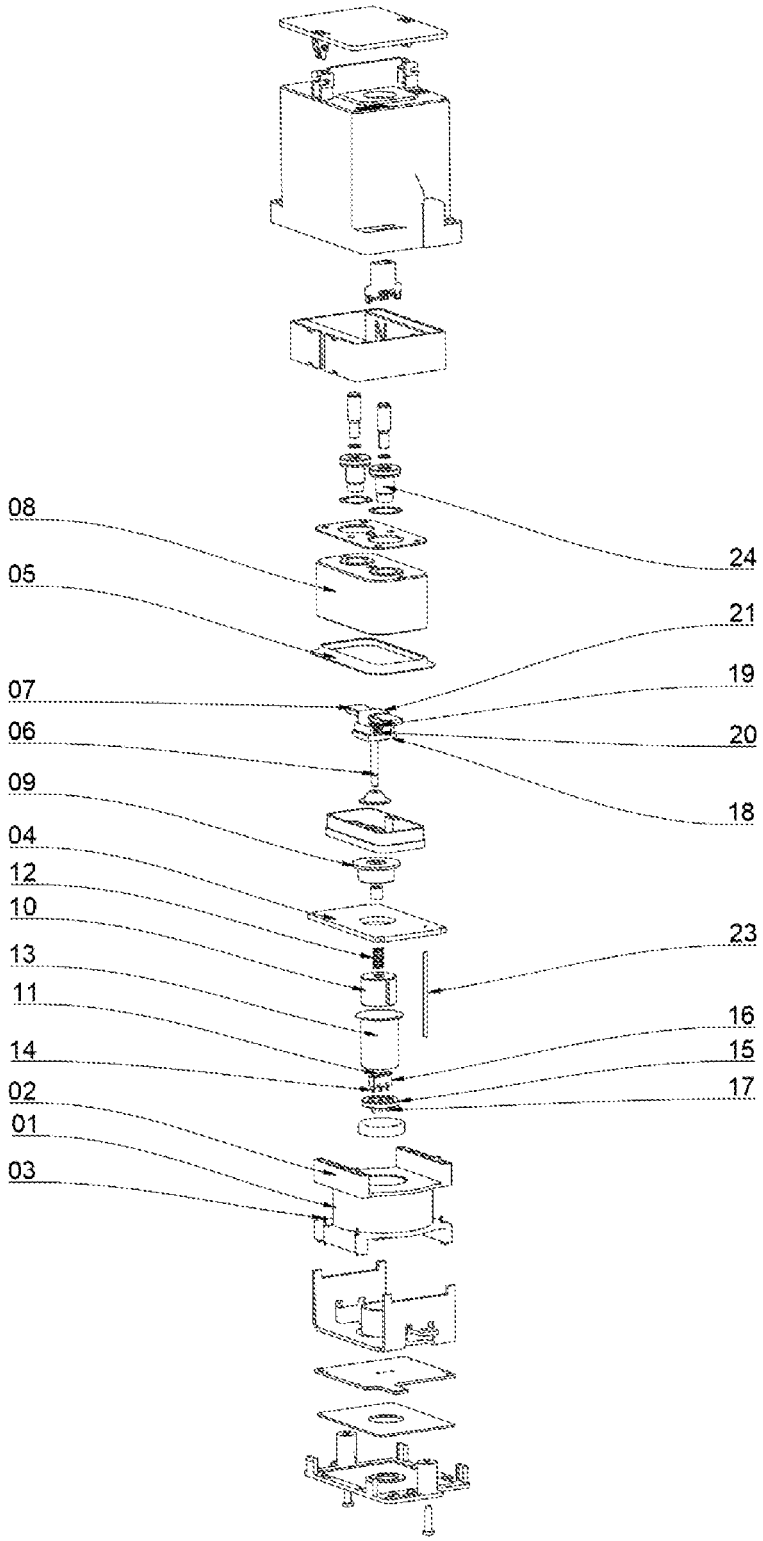
FIG. 1 is an assembly view for describing the structure of a direct current (DC) switching apparatus having an auxiliary contact device, according to an embodiment of the present invention.

FIG. 1 is an assembly view for describing the structure of a direct current (DC) switching apparatus having an auxiliary contact device, according to an embodiment of the present invention.

Referring to FIG. 1, an electromagnet may be made by winding a coil 01 around a bobbin 02 and connecting a start line and an end line of an electronic coil winding portion to a coil terminal 03, and a magnet of the electromagnet may be made by fitting a lower core into an inner groove of the center portion of the bobbin 02.

An inner compression spring 19 and an outer compression spring 20 may fit onto a movable table mold 18, a movable contact table 07 constituting a movable contact may fit onto a movable table holder 21, a movable pin 06 may fit into a central through hole of a stationary iron core 09 fixed to a yoke plate 04 by welding, a returning spring 12 may be assembled and may be fixed to a movable iron core 10 after adjusting an over travel (O/T), and then the auxiliary contact device may fit onto the bottom of a cylinder 13 and may be airtightly welded.

The cylinder 13 may be configured such that a lower circumferential portion of the cylinder 13 may be welded and bonded with a ceramic base 15, which is an insulator, by being made of a nonferrous metal in the form of a hollow cylinder and penetrating the bottom. Welding portions of the ceramic base 15 and the cylinder 13 may be airtightly bonded with each other by making a metalized layer 15-1 on an outer circumferential portion of the ceramic base 15, plating a penetrated lower circumferential portion 13-2 of the cylinder 13 with nickel such that the penetrated lower circumferential portion 13-2 may be welded with the metalized layer 15-1 formed on the ceramic base 15, and performing brazing welding by interposing a solder between the plated portion and the metalized layer 15-1.

The ceramic base 15 bonded with auxiliary contact terminals 17 formed of oxygen-free copper is airtightly bonded with the metalized layer 15-1 via brazing welding, terminals 14 of an microswitch 16 are coated with a liquid solder and fit into the auxiliary contact terminals 17 to be fixed and assembled, and the solder is melt by heating the auxiliary contact terminals 17 from the outside with a certain temperature, thereby electrically completely connecting the auxiliary contact terminals 17 to the terminals 14 of the microswitch 16.

As such, when creation of an auxiliary contact device (assembly) 22 is completed, the auxiliary contact device 22 is fitted onto the movable iron core 10 located below the moving table mold 18 and airtightly welded with the yoke plate 04, thereby completing an arrangement of an auxiliary contact.

When the welding of the yoke plate 04 is completed, a seal cup 05 airtightly welded with the bottom surface of a ceramic housing 08, which is an insulator of a stationary contact 24, may be bonded with the yoke plate 04 via airtight welding. At this time, an air-exhaust and air-supply tube may be made by airtightly welding a copper pipe 23 formed of oxygen-free copper with a hole formed in the yoke plate 04. The inside of the switching apparatus is rendered into a vacuum state by using the copper pipe 23 and is sealed with an insulation gas that maintains external insulation gas with a higher density than the atmospheric pressure such that the switching apparatus is completely blocked from ambient air, thereby manufacturing a DC high-voltage contact switching apparatus having a sealing structure that prevents discoloration of a contact table and a contact surface carbon phenomenon caused by arc.

In the present invention, to address conventional problems, the microswitch 16 to be used as the auxiliary contact may be arranged below the cylinder 13 and may be electrically connected to the auxiliary contact terminals 17 welded to the ceramic base 15 of the auxiliary contact device 22.

The DC high-voltage contact switching apparatus manufactured in this way may provide easy assembly of the microswitch 16 and may be protected from an arc voltage and arc heat due to opening/closing of a main contact. In addition, the inconvenience of attaching and soldering a conventional auxiliary contact to a PCB, soldering a terminal connected to the outside on the same PCB and sealing the terminal with epoxy, and then again soldering a lead line formed of an insulation wire, and the difficulty in securing insulation between an externally-exposed auxiliary contact terminal and a main contact may be addressed, and the convenience of having to insulate a soldering result obtained by soldering the external terminal of the auxiliary contact with the lead line nay be reduced.

This DC switching apparatus may drive arc by using an arc driving coil in order to extinct arc. In order to secure the reliability of the auxiliary contact that monitors an operational state of the main contact from an arc voltage and arc heat that accompany an operation of opening/closing DC power by driving arc by arranging a permanent magnet, the DC high-voltage contact switching apparatus according to an embodiment of the present invention may provide a structure of arranging the microswitch 16, which is to be used as the auxiliary contact, below the cylinder 13, accommodating the microswitch 16 below the movable iron core 10 and spacing the microswitch 16 apart from the main contact in a harsh arc environment such that the auxiliary contact may avoid a direct impact of arc.

As such, the present invention relates to a method of implementing an auxiliary contact of a sealed DC contact switching apparatus, and thus may provide a method for stably protecting insulation of an microswitch, which is to be used as the auxiliary contact, and the auxiliary contact in a harsh environment of opening/closing DC power of the main contact and securing reliability of an operational of the auxiliary contact of accurately monitoring an operational state of the main contact and transmitting an electrical signal.

Figure 2:
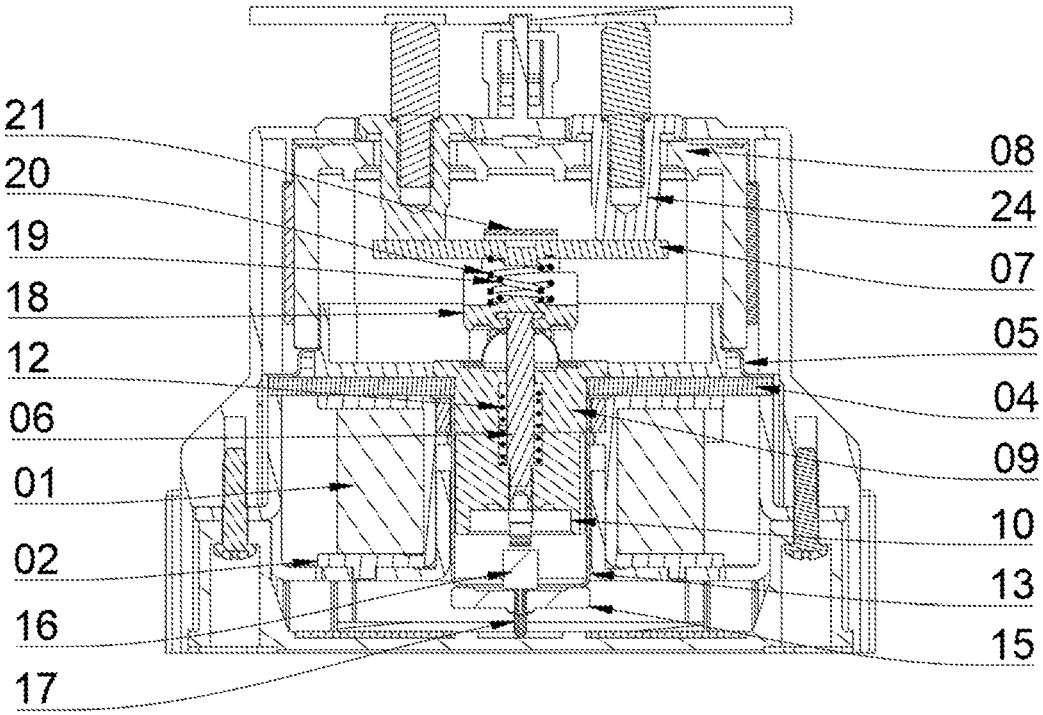
FIG. 2 is a cross-sectional view for describing the structure of a DC switching apparatus having an auxiliary contact device, according to an embodiment of the present invention.

FIG. 2 is a cross-sectional view for describing the structure of the DC switching apparatus having the auxiliary contact device, according to an embodiment of the present invention.

Referring to FIG. 2, because the auxiliary contact device including the microswitch 16 may be arranged in a lower portion of the DC switching apparatus, the auxiliary contact device is a long distance apart from the main contact and thus the auxiliary contact may avoid a direct impact of an arc voltage and arc heat.

When coil manipulation power is applied (on) to the coil terminal 03 extending from the excitation coil 01, the movable iron core 10 is moved to the stationary iron core 09 according to the principle of an electromagnet. At this time, while the lower surface of the movable iron core 10 fixed to the movable pin 06 of a movable mold assembly interlocked with the movable contact table 07 is moving upwards, an auxiliary contact lever 11 formed on the upper surface of the microswitch 16 may be returned to operate the auxiliary contact.

On the other hand, when the coil manipulation power is off, the movable iron core 10 is spaced apart from the stationary iron core 09 and moves downwards, in contrast with the above-described operation. At this time, the movable iron core 10 interlocked with the movable contact table 07 may press the auxiliary contact lever 11 and thus the microswitch 16 may be changed to an open-circuit or closed-circuit state. The auxiliary contact lever 11 may be configured as a type where a lever operates to press a button, or may be configured as a type including only a lever or a button.

According to this operation, the auxiliary contact device using the microswitch 16 may monitor the operational state of the main contact at a remote distance.

Figure 3:
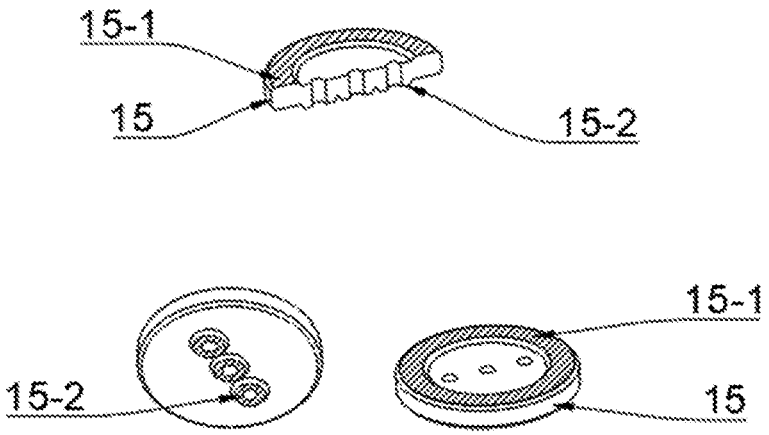
FIG. 3 is a view for describing the structure of a ceramic base from among the components of the auxiliary contact device according to an embodiment of the present invention.

FIG. 3 is a view for describing the structure of the ceramic base 15 from among the components of the auxiliary contact device according to an embodiment of the present invention.

Referring to FIG. 3, the ceramic base 15 formed of an insulating material may have a circular shape, and may include a first metalized layer 15-1 formed on an outer circumferential portion of the upper surface of the ceramic base 15. The first metalized layer 15-1 may be bonded with the lower surface of the cylinder 13 via brazing airtight-welding.

The ceramic base 15 may also include a plurality of through holes 15-2 through which the terminals 14 of the microswitch 16 penetrate. A second metalized layer may be formed on the through holes 15-2 of the lower surface of the ceramic base 15. The auxiliary contact terminals 17 may be airtightly welded to the ceramic base 15 by using the second metalized layer on the through holes 15-2 via brazing welding.

As such, the ceramic base 15 may include, on the upper surface thereof, the first metalized layer 15-1 for airtight welding with the cylinder 13 and may include, on the lower surface thereof, the second metalized layer for airtight welding with the auxiliary contact terminals 17.

Figure 4:
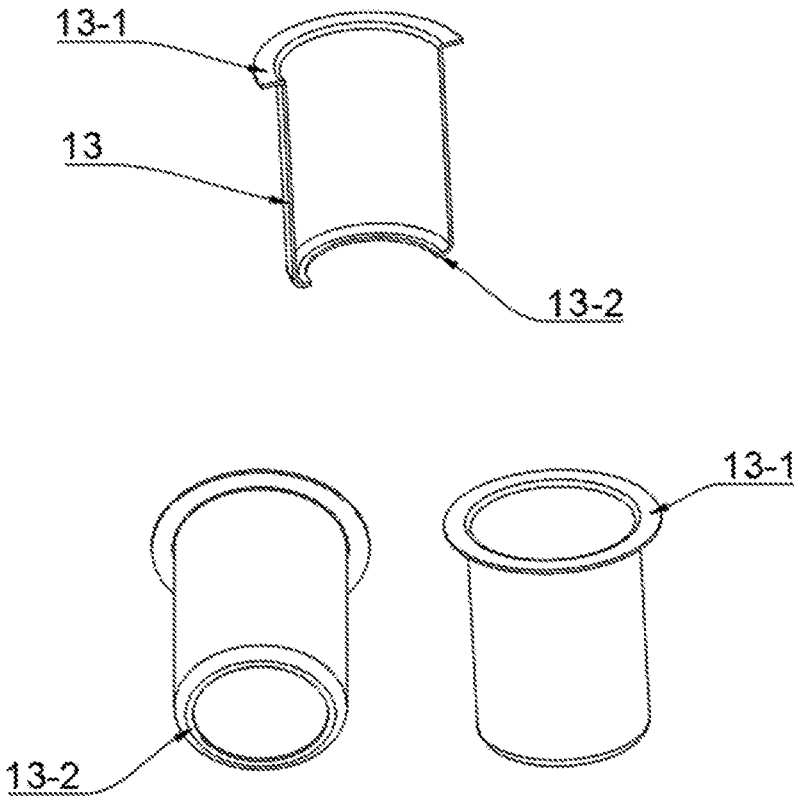
FIG. 4 is a view for describing the structure of a cylinder from among the components of the auxiliary contact device according to an embodiment of the present invention.

FIG. 4 is a view for describing the structure of the cylinder 13 from among the components of the auxiliary contact device according to an embodiment of the present invention.

Referring to FIG. 4, the cylinder 13 may have a cylindrical shape having an open top and an open bottom, and thus may include an upper circumferential portion 13-1 and a lower circumferential portion 13-2. The upper circumferential portion 13-1 may be formed in an outward direction to be perpendicular to the cylinder 13, and may be configured to be airtight welded to and bonded with the yoke plate 04. The lower circumferential portion 13-2 may be formed in an inward direction to be perpendicular to the cylinder 13. The lower circumferential portion 13-2 of the cylinder 13 may be configured to be airtight welded to and bonded with the first metalized layer 15-1 of the ceramic base 15.

Figure 5A:
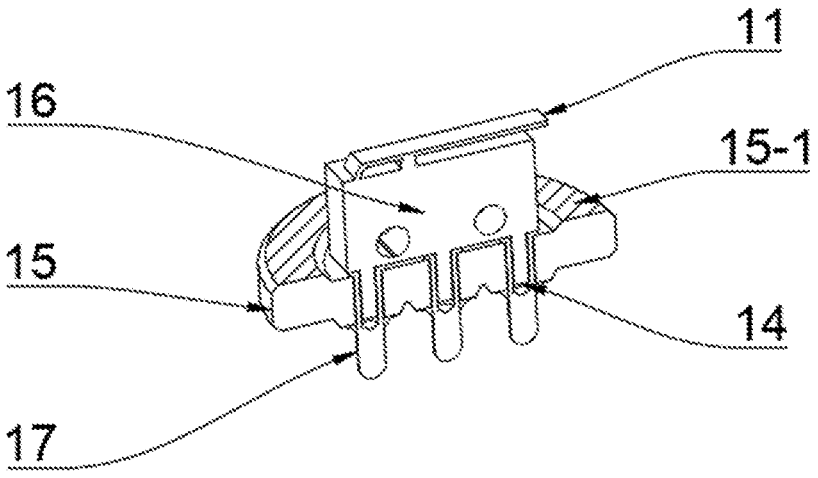
FIG. 5A is a cut-away perspective view for explaining the structure of an auxiliary contact device according to an embodiment of the present invention.
Figure 5B:
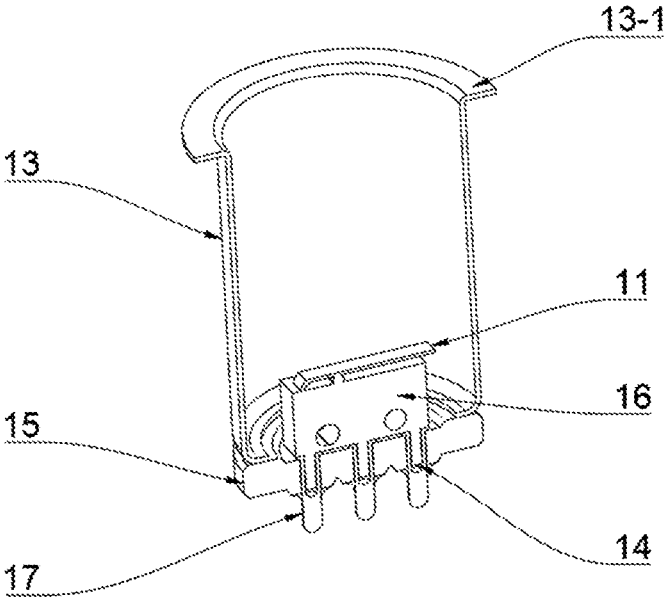
FIG. 5B is a cut-away perspective view for explaining the structure of an auxiliary contact device according to an embodiment of the present invention.

FIGS. 5A and 5B are cut-away perspective views for explaining the structure of the auxiliary contact device according to an embodiment of the present invention.

FIG. 5A illustrates a combination of the ceramic base 15 and the microswitch 16 according to an embodiment of the present invention.

After the second metalized layer is formed on the lower surfaces of the through holes 15-2 such that the auxiliary contact terminals 17 are airtight welded to and bonded with the ceramic base 15, the auxiliary contact terminals 17 are airtightly bonded with the ceramic base 15. After the terminals 14 of the microswitch 16 are coated with a liquid solder and are accommodated into the internal holes of the auxiliary contact terminals 17, the auxiliary contact terminals 17 are indirectly heated from an external source with a certain temperature and thus fixed and electrically connected to the terminals 14 to thereby prevent separation of the assembly. The auxiliary contact terminals 17 may be formed of oxygen-free copper.

The terminals 14 of the microswitch 16 may be fitted onto the auxiliary contact terminals 17 and thus fixed thereto. The terminals 14 of the microswitch 16 may transmit an electrical signal to the outside by being electrically connected to the auxiliary contact terminals 17.

In such a method of arranging the auxiliary contact device, the auxiliary contact terminals 17 formed in the ceramic base 15 perform a fixing role such that the microswitch 16 accommodated in the ceramic base 15 may be stably fixed without moving.

FIG. 5B illustrates a combination of the cylinder 13 and the ceramic base 15 according to an embodiment of the present invention.

At least a portion of the lower circumferential portion 13-2 of the cylinder 13 may be plated with, for example, nickel, and the lower circumferential portion 13-2 of the cylinder 13 and the first metalized layer 15-1 formed on the outer circumference of the ceramic base 15 may be airtightly bonded with each other via brazing welding.

Because contact opening/closing is conducted in a small space within the cylinder 13 through the above-described structure of the auxiliary contact device, infiltration of a carbon material generated during opening/closing of a contact due to arc and opening/closing of a main contact into the auxiliary contact may be minimized, the inside of a contact portion may be completely blocked from the outside, and an auxiliary contact device capable of blocking the inside of a product from a corrosive gas such as oxygen by completely blocking external air may be secured.

Figure 6:
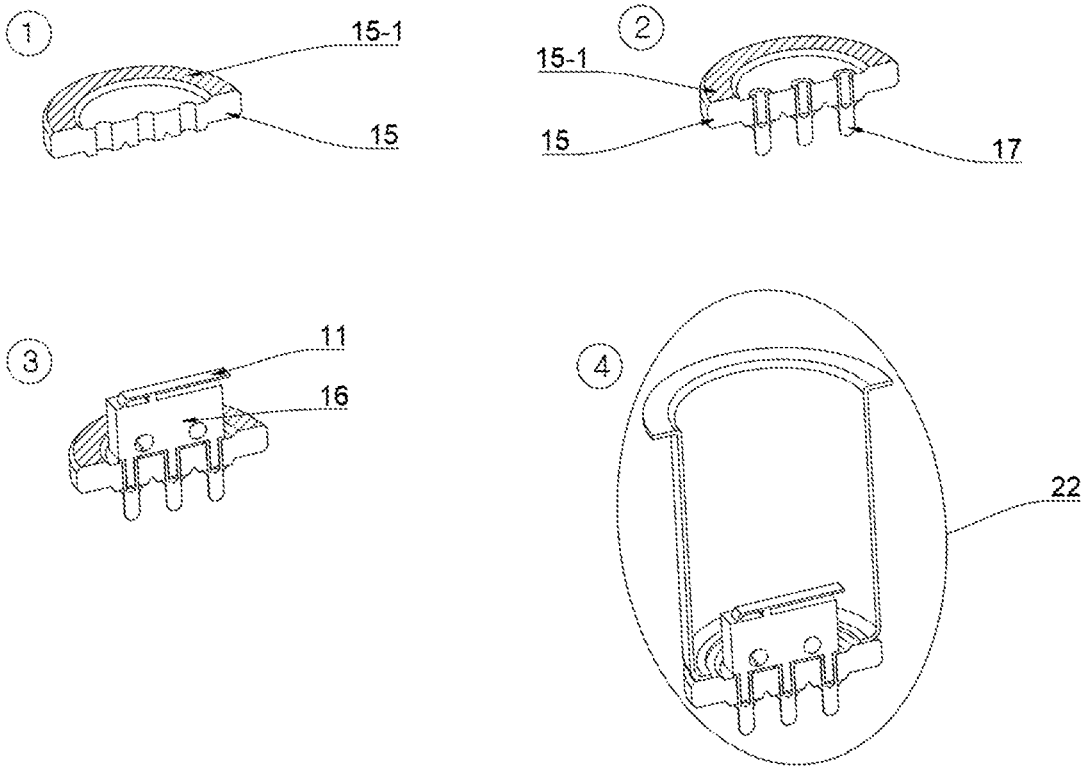
FIG. 6 is a view for describing a method of manufacturing an auxiliary contact device, according to an embodiment of the present invention.

FIG. 6 is a view for describing a method of manufacturing the auxiliary contact device 22, according to an embodiment of the present invention.

As described above, as shown in ① of FIG. 6, the first metalized layer 15-1 may be formed on the outer circumferential portion of the upper surface of the ceramic base 15.

Next, as shown in ② of FIG. 6, the second metalized layer may be formed on the bottom surface of the through holes 15-2 to bond the auxiliary contact terminals 17 to the ceramic base 15 via airtight welding, and then the bonding of the auxiliary contact terminals 17 may be achieved.

Next, as shown in ③ of FIG. 6, the terminals 14 of the microswitch 16 having the auxiliary contact lever 11 are coated with a liquid solder and accommodated into the grooves of the auxiliary contact terminals 17, and the auxiliary contact terminals 17 are indirectly heated from the outside at a constant temperature and thus fixed and electrically connected to the terminals 14, and thus the microswitch 16 may be combined with the ceramic base 15 and stably fixed thereto.

Finally, as shown in ④ of FIG. 6, the lower circumferential portion 13-2 of the cylinder 13 may be bonded with the first metalized layer 15-1 of the ceramic base 15 via airtight welding, thereby completing the manufacture of the auxiliary contact device 22.

The above-disclosed embodiments of the present invention are merely examples, and thus the present invention is not limited thereto. The scope of the present invention should be interpreted by the following claims, and all technologies within the scope equivalent thereto should be interpreted as being included in the scope of the present invention.

DESCRIPTION OF REFERENCE NUMERALS

| | |
|---|---|
| 01: coil | 02: bobbin |
| 03: coil terminal | 04: yoke plate |
| 05: seal cup | 06: movable pin |
| 07: movable contact table | 08: ceramic housing |
| 09: stationary iron core | 10: movable iron core |
| 11: auxiliary contact lever | 12: returning spring |
| 13: cylinder | 14: micro switch terminal |
| 15: ceramic base | 16: microswitch |
| 17: auxiliary contact terminal | 18: movable table mold |
| 19: inner compression spring | 20: outer compression spring |
| 21: movable table holder | 22: auxiliary contact device (assembly) |
| 23: copper pipe | 24: stationary contact |

What is claimed is:

1. A direct current (DC) switching apparatus having an auxiliary contact device, the DC switching apparatus comprising:

at least one pair of stationary contacts;

one or more coils;

a movable iron core that is driven by the one or more coils;

a movable contact table operating in engagement with the movable iron core; and an auxiliary contact device arranged below the movable iron core, wherein the auxiliary contact device comprises:

a microswitch;

a cylinder of which a top and a bottom are open, the cylinder comprising an upper circumferential portion and a lower circumferential portion; and a ceramic base configured to be airtightly bonded with the lower circumferential portion of the cylinder, wherein a first metalized layer is formed on an outer circumferential portion of the ceramic base, and the first metalized layer and the lower circumferential portion of the cylinder are bonded with each other via airtight welding.

2. The DC switching apparatus of claim 1, wherein a terminal of the microswitch is fitted onto and fixed to an auxiliary contact terminal formed in the ceramic base, and the terminal of the microswitch is able to transmit an electrical signal to the outside by being electrically connected to the auxiliary contact terminal.

3. The DC switching apparatus of claim 2, wherein the ceramic base comprises a through hole through which the terminal of the microswitch penetrates, and the auxiliary contact terminal is bonded via airtight welding by using a second metalized layer formed on the through hole.

4. The DC switching apparatus of claim 2, wherein the microswitch comprises an auxiliary contact lever, is able to monitor a state of a main contact through the auxiliary contact terminal as a lower portion of the movable iron core operates the auxiliary contact lever through a vertical action of the movable iron core, and is configured to be filled with an insulating gas.

5. The DC switching apparatus of claim 2, wherein the terminal of the microswitch is coated with a liquid solder and then fitted onto the auxiliary contact terminal, and the terminal of the microswitch and the auxiliary contact terminal are electrically connected to each other by heating the auxiliary contact terminal from the outside.

6. The DC switching apparatus of claim 2, wherein the auxiliary contact terminal is formed of oxygen-free copper, at least a portion of the lower circumferential portion of the cylinder is plated, and the lower circumferential portion of the cylinder and the first metalized layer of the ceramic base are bonded with each other via brazing welding.

7. The DC switching apparatus of claim 1, wherein the upper circumferential portion of the cylinder is formed in an outward direction to be perpendicular to the cylinder, and the lower circumferential portion of the cylinder is formed in an inward direction to be perpendicular to the cylinder.

* * * * *